US006896577B1

(12) United States Patent
Feng

(10) Patent No.: US 6,896,577 B1
(45) Date of Patent: May 24, 2005

(54) CONFIGURATION FOR A COLLAPSIBLE THROWING TOY AND ITS ASSOCIATED METHOD OF MANUFACTURE

(76) Inventor: Jung Chung Feng, Ma On Shan, Shatin, New Territories, Hong Kong (CN)

( * ) Notice: Subject to any disclaimer, the term of this patent is extended or adjusted under 35 U.S.C. 154(b) by 0 days.

(21) Appl. No.: 10/780,371

(22) Filed: Feb. 17, 2004

(51) Int. Cl.[7] ..... A63H 33/00

(52) U.S. Cl. ..... 446/486; 446/46; 446/92; 446/487; 473/572

(58) Field of Search ..... 446/486, 46, 487, 446/71, 72, 92; 473/572, 573, 588, 593, 595, 612

(56) References Cited

U.S. PATENT DOCUMENTS 2,952,460 A * 9/1960 Ellis ..... 473/609
3,218,071 A * 11/1965 Eugene ..... 473/594
4,790,714 A * 12/1988 Schnapp ..... 446/486
4,955,841 A * 9/1990 Pastrano ..... 446/46
5,096,751 A * 3/1992 Duchek ..... 428/12
5,797,815 A * 8/1998 Goldman et al. ..... 473/588
D441,107 S * 4/2001 Okuda ..... D26/28

* cited by examiner

*Primary Examiner*—Bena B. Miller
(74) *Attorney, Agent, or Firm*—Lamorte & Associates

(57) ABSTRACT

A toy assembly and its method of manufacture. The toy assembly is a spherical object that can be temporarily compressed into a disc. A short time after compression, the toy pops back into its original ball-like shape. The toy assembly has arcuate sections that join form a generally spherical body. The arcuate sections are symmetrically disposed around a central axis. The spherical body is bisected by an imaginary equatorial plane that is perpendicular to the central axis. A leaf spring is provided behind each of the arcuate sections that bias the arcuate sections into a spherical shape. A connector mechanism is provided that temporarily connect opposite sides of the spherical body when the spherical body is compressed. The leaf springs provide a spring bias that resists any compression and causes the arcuate sections to return to a spherical shape when the connector mechanism release.

18 Claims, 6 Drawing Sheets

CONFIGURATION FOR A COLLAPSIBLE THROWING TOY AND ITS ASSOCIATED METHOD OF MANUFACTURE

BACKGROUND OF THE INVENTION

1. Field of the Invention

In general, the present invention relates to toy objects that are spring biased in an expanded configuration, yet can be temporarily configured into a collapsed configuration. More particularly, the present invention relates to thrown toy objects, such as balls, that can be temporarily pressed into a collapsed configuration, wherein the thrown toy pops back into an expanded configuration a short time later. The present invention also relates to the method of manufacturing such toy objects.

2. Description of the Prior Art

The prior art is replete with various types of toys that are intended to be thrown. Prominent among such toys are balls and discs. It therefore is not surprising that toy manufacturers eventually combined the features of a ball and a disc into a single throwing toy.

It is for this reason that collapsible ball throwing toys were first introduced into the toy market. Collapsible ball throwing toys are balls, or similar spherically shaped objects, that are comprised of an upper hemisphere and a lower hemisphere. The upper hemisphere and the lower hemisphere are joined together with hinged connections along a common equatorial joint. Due to the hinged connections between the upper hemisphere and the lower hemisphere, the upper and lower hemispheres of the ball can be collapsed flat against each other. When the upper and the lower hemispheres of the toy are collapsed against each other, the toy has the general configuration of a disc. Accordingly, the collapsible ball throwing toy can be configured as either a ball or as a disc, depending upon whether or not the toy is compressed.

As the upper and lower hemispheres of the toy are collapsed into a flat configuration, the diameters of the hemispheres expand. To accommodate this expansion, the upper and lower hemispheres of the toy are slotted. When the toy is fully expanded into its ball shape, the slots are closed and the toy has a continuous external surface. However, when the toy is flattened into a disc, the slots open and expand, giving the disc a daisy configuration. A typical daisy configuration of a collapsible ball throwing toy can be seen by referencing U.S. Patent No. Des 434,457 to Goldman, entitled Collapsible Toy.

In the prior art, collapsible ball throwing toys typically have some sort of biasing element that biases the collapsible ball throwing toy into its expanded, ball-like configuration. For example, in U.S. Pat. No. 5,797,815 to Goldman, entitled Pop-Open Throwing Toy With Controllable Opening Delay And Method Of Operating Same, a collapsible ball throwing toy is shown that has an internal coil spring. The coil spring biases apart the upper and lower hemispheres of the toy. The collapsible ball throwing toy can be temporarily configured like a disc by compressing the internal coil spring and resisting the bias of the coil spring with a momentary suction cup connection between the upper and lower hemispheres. As soon as the momentary suction cup connection fails, the internal coil spring pops the collapsible ball throwing toy back into its expanded ball-like configuration.

In U.S. Pat. No. 4,955,841 to Pastrano, entitled Disc-Shaped Throwing Toy, a collapsible ball throwing toy is disclosed. The collapsible ball throwing toy is shaped like a polyhedron. The collapsible ball throwing toy has an upper and lower hemisphere joined with a hinged connection along an equatorial joint. An elastic element is provided within the polyhedron that biases it into a generally spherical shape. When compressed, the hemispheres flatten along lines in the polyhedral pattern and expand at the equatorial joint. Due to the hinged connection at the equatorial joint, the upper and lower hemispheres can fold flat against each other. However, once a compressing force is removed, internal elastic element causes both hemispheres to slowly return to their expanded shapes. As such, the collapsible ball throwing device can be flattened and thrown. After being thrown, the collapsible ball throwing device slowly returns to its expanded spherical shape. This prior art design, therefore, lacks the desired sudden transition between its collapsed condition and its expanded condition that other prior art versions of the collapsible ball throwing toy embody.

In the manufacturing of prior art collapsible ball throwing toys, one of the controlling costs is how to form the biasing mechanism that biases the toy into its expanded form. If a coil spring is used, there is the cost of the coil spring and the configurations needed to retain the coil spring. Furthermore, there is the concern that coil springs present a pinching hazard to the fingers of children as they are being compressed. If an elastic element is attached to shell of the collapsible ball throwing toy for use as the biasing mechanism, a complicated shell configuration must be used that greatly increases the costs involved in tooling and assembling the toy.

Furthermore, it is desirable that the collapsible ball throwing toy suddenly pop between its flat configuration and its expanded configuration. The collapsible ball throwing toy must therefore have a strong biasing mechanism and an equally strong temporary connecting mechanism that temporarily resists the biasing mechanism. However, the biasing mechanism cannot present a pinching hazard, nor can it be disrupted by dirt and debris that might find its way into the collapsible ball.

A need therefore exists for a collapsible ball throwing toy that can be simplified in its construction so that it can be manufactured less expensively and operate better than prior art configurations. This need is met by the present invention as described and claimed below.

SUMMARY OF THE INVENTION

The present invention is a toy assembly and its method of manufacture. The toy assembly is a ball or similar object that can be temporarily compressed into a disc-shaped object. A short time after compression, the toy pops back into its original ball-like shape.

The toy assembly has a plurality of arcuate sections joined to opposite end hubs to form a generally spherical body. The arcuate sections are symmetrically disposed around a central axis. The spherical body is bisected by an imaginary equatorial plane that is perpendicular to the central axis. A connector mechanism is provided that has two opposing components that temporarily connect when brought into abutment. The opposing components are disposed within the spherical body in line with the central axis. The arcuate sections used in the toy bend in a joint disposed along the equatorial plane. The bending of the arcuate sections enable the spherical body of the toy to be compressed into a non-spherical shape. When in this non-spherical shape, the opposing components of the connector mechanism abut and temporarily connect. Leaf springs are provided in each of the arcuate sections that provide a spring bias to the arcuate sections. The spring bias resists compression and causes the arcuate sections to return to a spherical shape when the opposing components of the connector mechanism release. The toy therefore pops back into its spherical shape after remaining compressed for a period of time.

BRIEF DESCRIPTION OF THE DRAWINGS

For a better understanding of the present invention, reference is made to the following description of exemplary embodiments thereof, considered in conjunction with the accompanying drawings, in which.

DETAILED DESCRIPTION OF THE DRAWINGS

Figure 1:
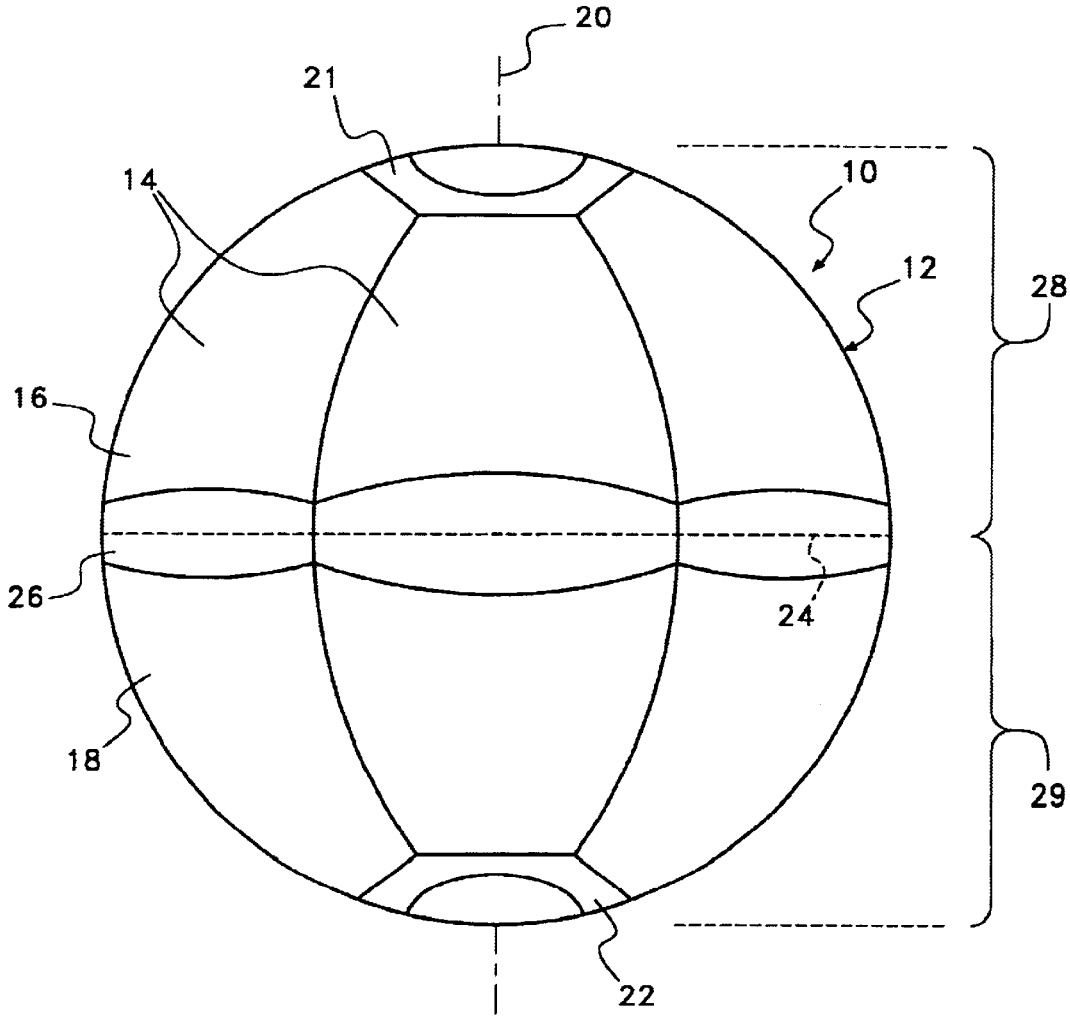
FIG. 1 is a perspective view of an exemplary embodiment of the present invention shown in its expanded condition.

The present invention is a collapsible ball throwing toy and its associated method of manufacture. Referring to FIG. 1, an exemplary embodiment of a collapsible ball throwing toy 10 is shown. The collapsible ball throwing toy 10 has a spherical body 12 that is made from a variety of sections. The different sections that comprise the spherical body 12 are symmetrically disposed around a central axis 20.

Two end hub assemblies 21, 22 are provided. The end hub assemblies 21, 22 are disposed at opposite ends of the spherical body 12, but both end hub assemblies 21, 22 are positioned along the central axis 20 of the collapsible ball throwing toy 10. A plurality of collapsible arcuate sections 14 extend between the two end hub assemblies 21, 22. In the shown embodiment, six collapsible arcuate sections 14 are shown. However, such a configuration is merely exemplary and it should be understood that any plurality of collapsible arcuate sections can be used.

Each of the collapsible arcuate sections 14 contains an upper panel 16, a lower panel 18 and a joint element 26. If the end hub assemblies 21, 22 are considered to be positioned along the same central axis 20 at different pole ends of the spherical body 12, an imaginary equatorial plane 24 exists between the end hub assemblies 21, 22. The equatorial plane 24 bisects the spherical body 12, dividing the spherical body 12 into an upper hemisphere 28 and a lower hemisphere 29. The joint elements 26 of each of the collapsible arcuate sections 14 are disposed along the equatorial plane 24. The upper panel 16 of each collapsible arcuate section 14 is in the upper hemisphere 28 above the equatorial plane 24. Conversely, the lower panel 18 of each collapsible arcuate section 14 is in the lower hemisphere 29 below the equatorial plane 24.

As will later be more fully described, a mechanical connector, such as a suction cup, is disposed inside the spherical body 12 of the collapsible ball throwing toy 10 behind one of the end hub assemblies 21. A surface that can be temporarily engaged by the mechanical connector is disposed inside the spherical body 12 of the collapsible ball throwing toy 10 behind the opposite end hub assembly 22.

The collapsible arcuate sections 14 that form the spherical body 12 of the collapsible ball throwing toy 10 are made to fold at the joint elements 26 along the equatorial plane 24.

Figure 2:
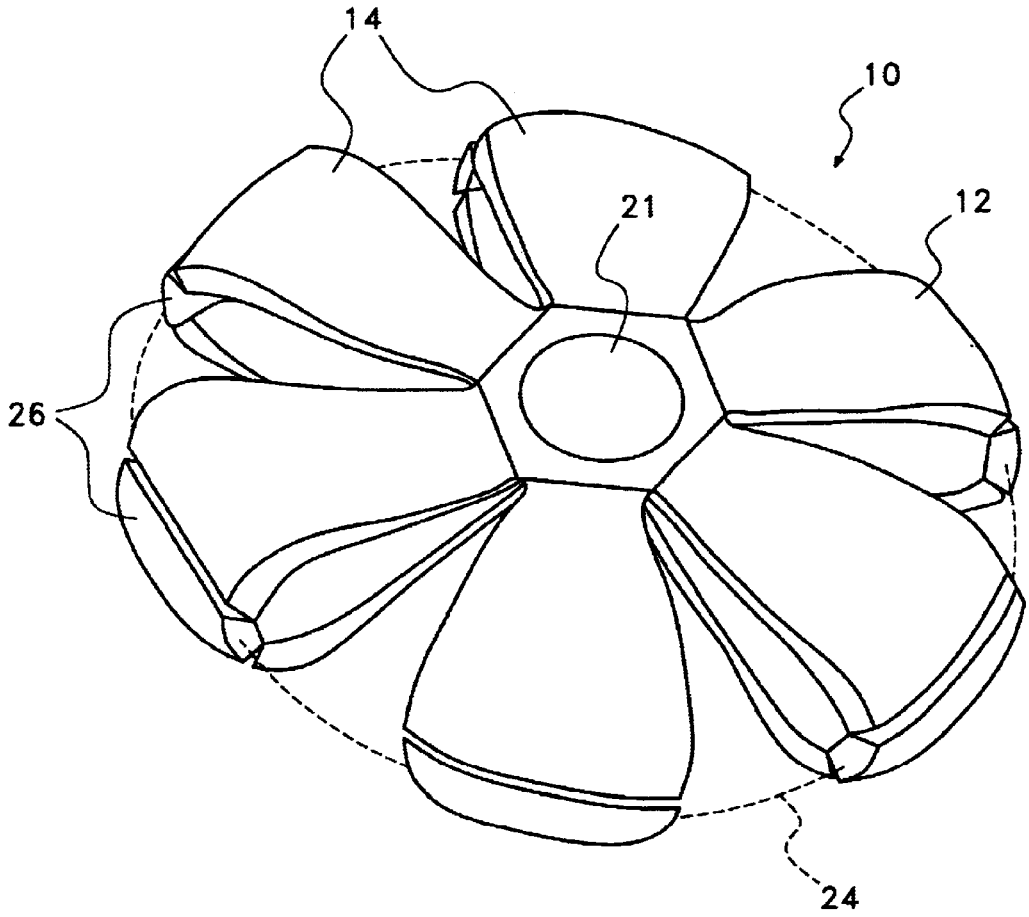
FIG. 2 is a perspective view of the embodiment of FIG. 1 shown in its compressed condition.

Referring to FIG. 2 in conjunction with FIG. 1, it can be seen that the spherical body 12 of the collapsible ball throwing toy 10 can be altered into a disc shape by pressing the two end hub assemblies 21, 22 toward each other. The two end hub assemblies 21, 22 meet at the imaginary equatorial plane 24 of the spherical body 12. As the two end hub assemblies 21, 22 approach one another, the mechanical connector behind one end hub assembly 21 temporarily engages a structure under the opposing end hub assembly 22. As the upper and lower hemispheres 28, 29 are compressed, the collapsible arcuate sections 14 fold at the joint elements 26. The spherical shape of FIG. 1, therefore transforms into the disc shape of FIG. 2.

As the various collapsible arcuate sections 14 fold, they each resist the folding deformation with a spring bias. The combined spring bias of all the collapsible arcuate sections 14 creates a force that opposes the compression. This spring bias causes the collapsible arcuate sections 14 to immediately pop back into a shape the instant the compression force is released or the two end hub assemblies 21, 22 release their interconnection. As such, the collapsible arcuate sections 14 themselves act as spring biasing mechanisms that bias the collapsible ball throwing device 10 into a ball-like shape.

Figure 3:
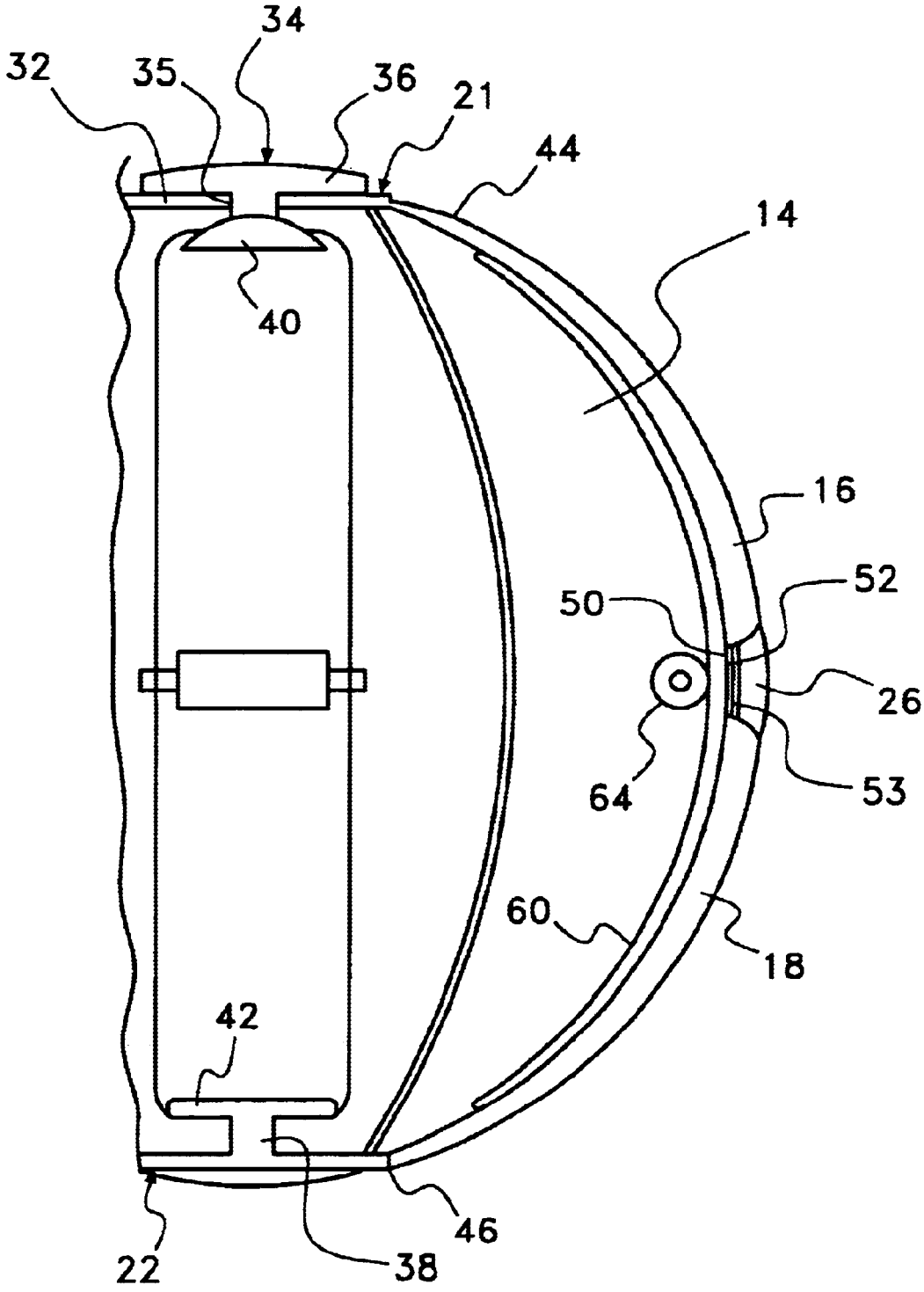
FIG. 3 is a cross-sectional view of an arcuate section contained within the present invention.

Referring to FIG. 3, it can be seen that the two end hub assemblies 21, 22 each include plastic base platforms 32. The plastic base platforms 32 are shaped as polyhedrons, having a number of side surfaces equal to the number of collapsible arcuate sections 14. A hole 35 is disposed in the center of each of the plastic base platforms 32. An end cap 34 is provided in each end hub assembly 21, 22. The end cap 34 has an enlarged head 36 with a curved exterior that matches the curvature of the exterior of the spherical body 12. A neck 38 extends down from the enlarged head 36 and passes through the hole 35 in the plastic base platform 32. A suction cup 40 is attached to the neck 38 of one of the end caps 34. In A suction plate 42 is attached to the neck 38 of the opposite end cap 34. When the two hub assemblies 21, 22 are pressed toward each other, the collapsible arcuate sections 14 fold and the suction cup 40 contacts and engages the suction plate 42. The connection between the suction cup 40 and the suction plate 42 is temporary. The two end hub assemblies 21, 22 are biased apart by the deforming collapsible arcuate sections 14, since the collapsible arcuate sections 14 are spring biased into a non-folded configuration.

Figure 4:
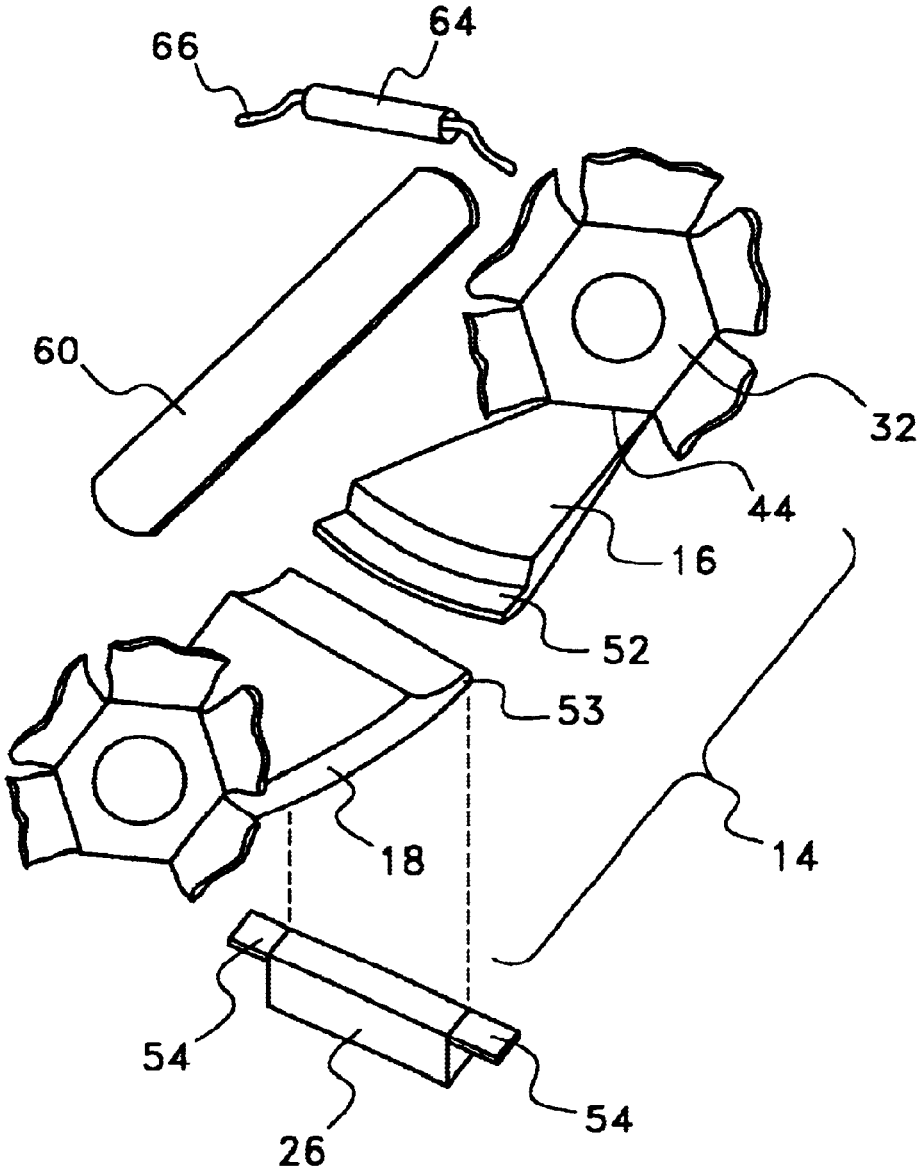
FIG. 4 is an exploded perspective view of the arcuate section shown in FIG. 3.

Referring now to FIG. 4 in conjunction with FIG. 3, it can be seen that each collapsible arcuate section 14 is comprised of an upper panel 16 and a lower panel 18. The upper panel 16 is integrally formed with the plastic base platform 32 of the upper end hub assembly 21. Similarly, the lower panel 18 is integrally formed with the plastic base platform 32 of the lower end hub assembly 22. The transition line 44 between the upper panel 16 and the end hub assembly 21 is thinned so that the transition line 44 acts as a hinge. In the same manner, the transition line 46 between the lower panel 18 and the end hub assembly 22 is thinned so that the transition line 46 acts as a hinge. A reinforcement patch 48 of fabric can be glued on the inside the spherical body 12 over the transition lines 44, 46 to help reinforce the created hinge and prevent the thinned transition lines 44, 46 from breaking after repeated use.

Each of the upper panels 16 and the lower panels 18 has an exterior that is molded to match the radius of curvature of the overall spherical body 12. As the upper and lower panels 16, 18 approach the equatorial plane 24, each of the panels 16, 18 thins to a flap 52, 53. The flaps 52, 53 from the upper panel 16 and the lower panel 18 overlap and are glued together to form a highly flexible hinge joint 50 at the equatorial plane 24.

The joint element 26 fits in between the upper panel 16 and the lower panel 18. The joint element 26 fits over the overlapping flaps 52, 53 and is glued to the overlapping flaps 52, 53. The joint element 26 can have end flairs 54 that wrap around the overlapping flaps 52, 53 and help retain the joint element 26 in place. The joint element 26 has an exterior that is curved to match the radius of curvature of the overall spherical body 12. In this manner, the joint element 26 fills the gap between the upper panel 16 and the lower panel 18 and creates a completely round external appearance to the spherical body 12. The joint element 26 also acts as a stop and prevents the upper panel 16 and the lower panel 18 from moving into a vertical orientation beyond the curvature of the spherical body 12.

A leaf spring 60 is disposed on the interior of each collapsible arcuate section 14. The leaf spring 60 expands across both the upper panel 16 and the lower panel 18. The leaf spring 60 is formed to be biased in a straight orientation. However, the leaf spring 60 is also designed to be resiliently bent in half without damage. The leaf spring 60 is placed against the interior of the collapsible arcuate sections 14. Since these surfaces are curved to the radius of curvature of the overall spherical body 12, each leaf spring 60 is slightly bent to conform to the curved shape.

A cylindrical bending block 64 is mounted to the center of the leaf spring 60. A strap 66 passes through the bending block 64 and is glued to the overlapping flaps 52, 53 of the upper and lower panels 16, 18. The strap 66 holds both the bending block 64 and the leaf spring 60 in place.

Figure 5:
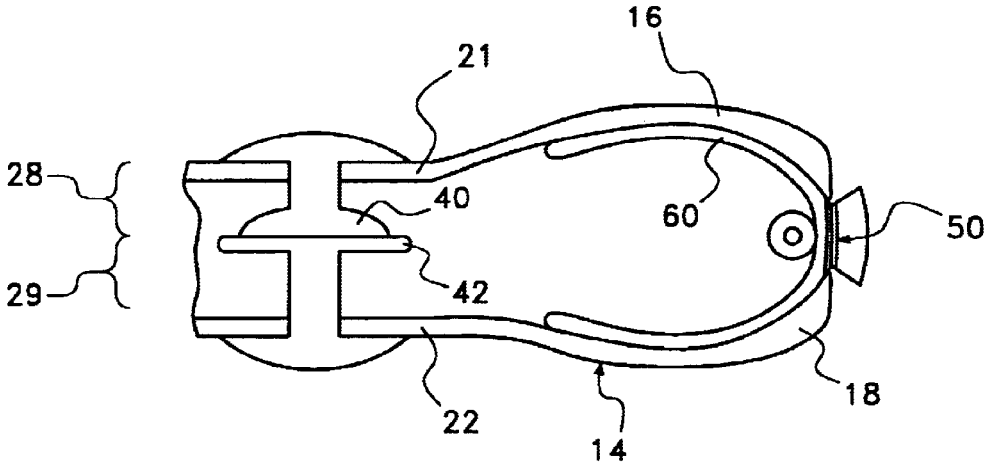
FIG. 5 is a cross-sectional view of the exemplary embodiment shown in a compressed condition.

Referring to FIG. 5, it can be seen that when the end hub assemblies 21, 22 are pressed toward each other the collapsible arcuate sections 14 fold in the center hinge joint 50 along the equatorial plane. The leaf spring 60, which is already slightly bent, further bends in half. The bending block 64 prevents the center of the leaf spring 60 from creasing by maintaining a wide loop in the center of the leaf spring 60 as it bends.

As the two end hub assemblies 21, 22 are moved toward each other, the leaf springs 60 in each of the collapsible arcuate sections 14 resist the deformation. The leaf springs 60 store potential energy as they bend. The bias of the leaf springs 60 acts to pull the two end hub assemblies 21, 22 away from each other so that that the upper and lower hemispheres 28, 29 can return to their original combined ball-like shape.

The spring bias created by the bent leaf springs 60 acts to pull the two end hub assemblies 21, 22 apart. This spring bias force eventually causes the suction cup 40 to pull away from the suction plate 42. As soon as this occurs, the spring bias in the leaf springs 60 cause the collapsible ball throwing toy 10 to instantly pop back into its ball-like shape.

Figure 6:
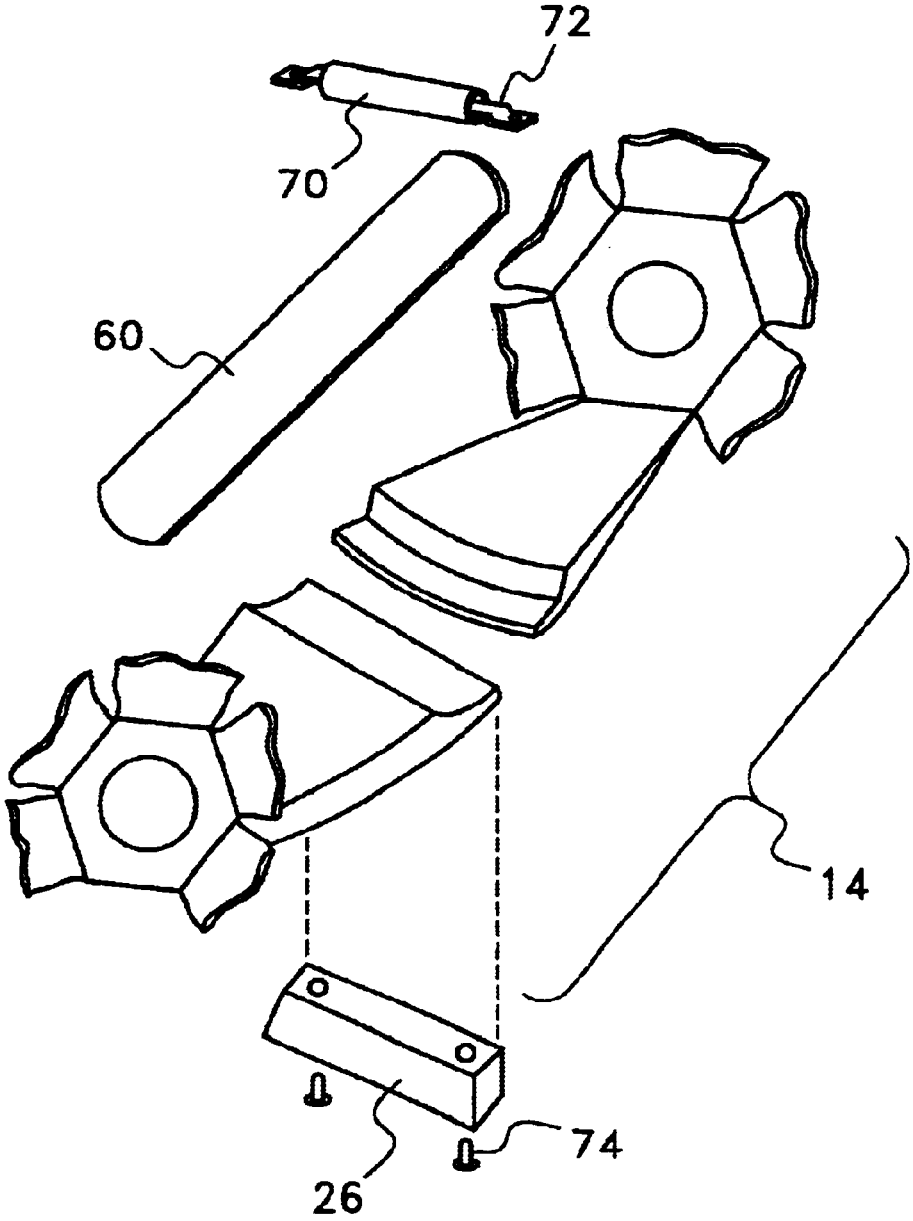
FIG. 6 is an exploded perspective view of an alternate embodiment of an arcuate section.

Referring to FIG. 6, an alternative embodiment of mounting the leaf spring 60 to the interior of a collapsible arcuate section 14 is shown. Since surrounding components are the same as has been previously described, like numbers are used to identify like parts. In this embodiment, a cylindrical bending block 70 is molded with mounting arms 72. Plastic rivets 74 are advanced through the joint element 26 and engage the mounting arms 72. The mounting arms 72 pass around the leaf spring 60 and limit its movement. In this manner, the leaf spring 60 becomes locked in position under the mounting arms 72.

As is illustrated by FIG. 6, there are many different configurations that can be used to mount the leaf spring in place or to join the various panels and hinge elements together. It will be understood that the embodiments of the present invention collapsible ball throwing toy that are described and illustrated herein are merely exemplary and a person skilled in the art can make many variations to the embodiments shown without departing from the scope of the present invention. For example, the suction based mechanical connector that is used to interconnect the end hub assemblies can be varied. Alternate connectors, such as Velcro, can be used in place of the suction cup, provided the connector provides a temporary interconnection after the toy is compressed. Furthermore, there are many ways that the end hub assemblies can be configured and mounted in place. The design described for the end hub assemblies is merely exemplary. Other configurations can be used provided the end hub assemblies provide the described function of providing a temporary interconnection when compressed. All such variations, modifications and alternate embodiments are intended to be included within the scope of the present invention as defined by the appended claims.

What is claimed is:

1. A toy assembly, comprising:

a plurality of arcuate sections forming a generally spherical body, said arcuate sections being symmetrically disposed around a central axis;

a plurality of leaf springs disposed within said generally spherical body, wherein one of said leaf springs is disposed along each of said arcuate sections;

a connector mechanism having two components that temporarily connect when brought into abutment, each of said components being disposed along said central axis on opposite sides of said spherical body;

wherein said arcuate sections are flexible and enable said spherical body to be compressed into a non-spherical shape so that said components of said connector mechanism abut and temporarily connect, said leaf springs providing a spring bias that resists compression and causes said arcuate sections to return to a generally spherical shape when said components of said connector mechanism disconnect.

2. The assembly according to claim 1, wherein said spherical body is bisected by an imaginary equatorial plane that is perpendicular to said central axis, and wherein each of said arcuate sections includes an upper panel and a lower panel that are joined with a hinged connection along said imaginary equatorial plane.

3. The assembly according to claim 2, wherein each said leaf spring extends between an upper panel and a lower panel across said hinged connection.

4. The assembly according to claim 3, wherein a bending block is disposed adjacent each of said leaf springs in said equatorial plane, wherein said bending block enables said leaf spring to fold without creasing when said spherical body is compressed.

5. The assembly according to claim 1, further including two end hubs disposed on opposite ends of said spherical body along said central axis, wherein said end hubs interconnect said arcuate sections to form said spherical body.

6. The assembly according to claim 5, wherein said end hubs support said components of said connector mechanism within said spherical body.

7. The assembly according to claim 1, wherein said components of said connector mechanism include a suction cup and a suction cup plate.

8. A method of forming a collapsible ball, comprising the steps of:

providing a plurality of arcuate sections;

joining said arcuate sections to form a body with a spherical shape that has a central axis and a equatorial plane perpendicular to said central axis;

providing a leaf spring adjacent each of said arcuate sections within said body that bias said arcuate sections into a configuration that forms said spherical shape;

providing a connector mechanism within said spherical body that causes opposing internal areas of said body to temporarily interconnect when said body is compressed and deformed out of said spherical shape and said opposing internal areas are brought into abutment.

9. The method according to claim 8, wherein said step of providing a plurality of arcuate sections includes providing a plurality of arcuate sections that have a hinge joint at a point where said equatorial plane bisects each of said arcuate sections.

10. The method according to claim 8, further including the step of providing a bending block for each said leaf spring.

11. The method according to claim 10, wherein each said leaf spring bends around said bending block when said body is compressed and deformed out of said spherical shape.

12. The method according to claim 8, further including the step of providing end hubs that support said arcuate sections to form said spherical body.

13. The method according to claim 8, wherein said end hubs support said connector mechanism within said spherical body.

14. The method according to claim 13, wherein said components of said connector mechanism include a suction cup and a suction cup plate.

15. A collapsible ball assembly, comprising:

a body having a center axis that can be selectively configured between a spherical shape and a disc shape, said body being comprised of a plurality of arcuate sections symmetrically disposed around said center axis;

a plurality of leaf springs, wherein one of said leaf springs is attached to each of said arcuate sections and biases said arcuate sections into said spherical shape;

a connection mechanism within said body that retains said body in said disc shape against the bias of said plurality of leaf springs a period of time after said body is compressed from said spherical shape into said disc shape.

16. The collapsible ball assembly according to claim 15, wherein said body has a equatorial plane and each of said plurality of arcuate sections has a hinge joint where intersected by said equatorial plane.

17. The collapsible ball assembly according to claim 15, further including end hubs that engage and retain said plurality of arcuate sections to form said body.

18. The collapsible ball assembly according to claim 15, wherein a bending block is disposed adjacent each of said leaf springs, wherein said bending block enables said leaf spring to fold without creasing when said body is compressed.

* * * * *